US010837687B2

(12) United States Patent
Cordon Compañ

(10) Patent No.: US 10,837,687 B2
(45) Date of Patent: Nov. 17, 2020

(54) SAFETY DEVICE FOR AN ICE MACHINE

(71) Applicant: INDUSTRIA TECNICA VALENCIANA, S.A., Valencia (ES)

(72) Inventor: Cristina Cordon Compañ, Valencia (ES)

(73) Assignee: ITV ICE MAKERS, S.L., Valencia (ES)

( * ) Notice: Subject to any disclaimer, the term of this patent is extended or adjusted under 35 U.S.C. 154(b) by 79 days.

(21) Appl. No.: 16/211,020

(22) Filed: Dec. 5, 2018

(65) Prior Publication Data

US 2020/0173704 A1 Jun. 4, 2020

(30) Foreign Application Priority Data

Dec. 3, 2018 (EP) ..... 18382885

(51) Int. Cl.
*F25C 1/00* (2006.01)

(52) U.S. Cl.
CPC ..... *F25C 1/00* (2013.01); *F25C 2500/08* (2013.01); *F25C 2700/00* (2013.01)

(58) Field of Classification Search
CPC ..... F25C 1/00; F25C 2500/08; F25C 2700/00
See application file for complete search history.

(56) References Cited

U.S. PATENT DOCUMENTS

| | | | | |
|---|---|---|---|---|
| 6,119,472 | A * | 9/2000 | Ross | A23G 9/16 62/228.2 |
| 7,849,699 | B2 * | 12/2010 | Allen | F25B 49/005 62/129 |
| 9,273,892 | B2 * | 3/2016 | Lee | F25C 5/08 |
| 9,939,187 | B2 * | 4/2018 | Lee | F25C 5/22 |
| 10,139,146 | B2 * | 11/2018 | Park | F25C 1/04 |
| 2009/0173084 | A1 * | 7/2009 | Heger | F25C 5/182 62/66 |
| 2010/0031679 | A1 * | 2/2010 | Park | F25C 5/06 62/129 |

* cited by examiner

*Primary Examiner* — Filip Zec
(74) *Attorney, Agent, or Firm* — Aslan Law, P.C.

(57) ABSTRACT

A safety device for an ice machine comprising a cover-type body (1), with a spherical cap shape, which is articulated on one of the ends (1*a*) thereof, while on the other end (1*b*) thereof it has a floating character and incorporates protuberances (1*c*) that make up the arrangement of an elastic closure (2) responsible for fastening said body to the ice machine (10); and wherein electronic means (3) are located adjacently to the body (1) in the placement area of an end of the elastic closure (2), which are responsible for detecting the change in position or opening of said body (1) and sending machine stop and breakdown warnings.

3 Claims, 3 Drawing Sheets

SAFETY DEVICE FOR AN ICE MACHINE

OBJECT OF THE INVENTION

The object of the present specification is a safety device for an ice machine, essentially made up of a hinged body that protects the outlet of the ice towards the outside, and which includes an elastic closure which prevents the outlet force of the ice from moving said body, and in turn, houses electronic means which detect the anomaly, sending a stop signal to the machine and an external warning which details the detected anomaly.

BACKGROUND OF THE INVENTION

Currently, in the outlet of the ice of the machines that produce it, the ice vertically exits the area of the extruder towards an outlet tube or channel responsible for guiding the obtained product towards the collection area.

Even though it is true that said operation is usually performed without difficulty, the fact remains that on certain occasions blockages occur in said area (as a consequence of a bad evacuation) and which cause a clog of said area, which, if fast action is not taken therein, can cause breakdowns in the different elements which make up the cited machine, as a consequence of the pressure exerted by the ice.

In order to alleviate said problem, the proposed solution incorporates electronic means for detecting said clog, sending a stop signal for the machine and an external signal so that the operator can act quickly regarding said anomaly and resume the operation thereof.

DESCRIPTION OF THE INVENTION

The technical problem resolved by the present invention is achieving means able to detect possible clogs or anomalies in the evacuation area of the product in an ice machine, which is able to stop the machine, thus preventing possible breakdowns therein, as a consequence of the cited breakdown. To do so, the safety device for an ice machine, object of the present specification, comprises a cover-type body, with a spherical cap shape, which is articulated on one of the ends thereof while on the other end thereof it has a floating character. And wherein, on this floating end, protuberances are located which make up the arrangement of an elastic closure, responsible for fastening said body to the ice machine; and wherein, the end having a floating character in turn acts as a housing area for electronic means responsible for detecting the change in position or opening of said body and sending machine stop and breakdown warnings.

Due to the design thereof, the ice machine will be completely safe from blockages in the outlet area of the ice, for which, in the event of a breakdown in said area, the machine will be completely stopped thus preventing other elements thereof from being damaged, as a consequence of the continuous operation of the machine.

The simplicity of the composition thereof means that it is a highly profitable product, compared to the cost related to the breakdown of other elements. To do so, when the blockage is detected, the machine is automatically stopped and the warning is sent so the operator can unblock the outlet duct as fast as possible. All of this compensates for the time that the machine is stopped compared to the inanition time that changing other parts of greater economic value in the ice machine would entail.

The electronic means will be configured both to send a complete stop signal to the means that control the entirety of the machine, and to send a warning signal of blockage or an anomaly, thus the warning will be attended by the specialized staff that said action requires. In turn, the electronic means will be configured to reset the machine and manage the self-recovery thereof when the blockage or breakdown has disappeared, whether automatically or due to the actions of an operator. This will cause, in the case of one-time blockages, as a consequence of a small piece of ice having produced a slight blockage, at the time it is resolved automatically (for example the thawing of said piece that was blocked), an automatic start-up of the machine to be produced, automatically regaining production, reducing the cost of maintenance jobs to only those considerable blockages that require specialized labor.

BRIEF DESCRIPTION OF THE FIGURES

What follows is a very brief description of a series of drawings that aid in better understanding the invention, and which are expressly related to an embodiment of said invention that is presented by way of a non-limiting example of the same.

DESCRIPTION OF A DETAILED EMBODIMENT OF THE INVENTION

The attached figures show a preferred embodiment of the invention. More specifically, the safety device for an ice machine, object of the present invention, is made up of a cover-type body (1), with a spherical cap shape, which is articulated on one of the ends (1*a*) thereof, while on the other end (1*b*) thereof it has a floating character, incorporates protuberances (1*c*) which make up the arrangement of an elastic closure (2) responsible for fastening said body to the ice machine (10).

Figure 1:
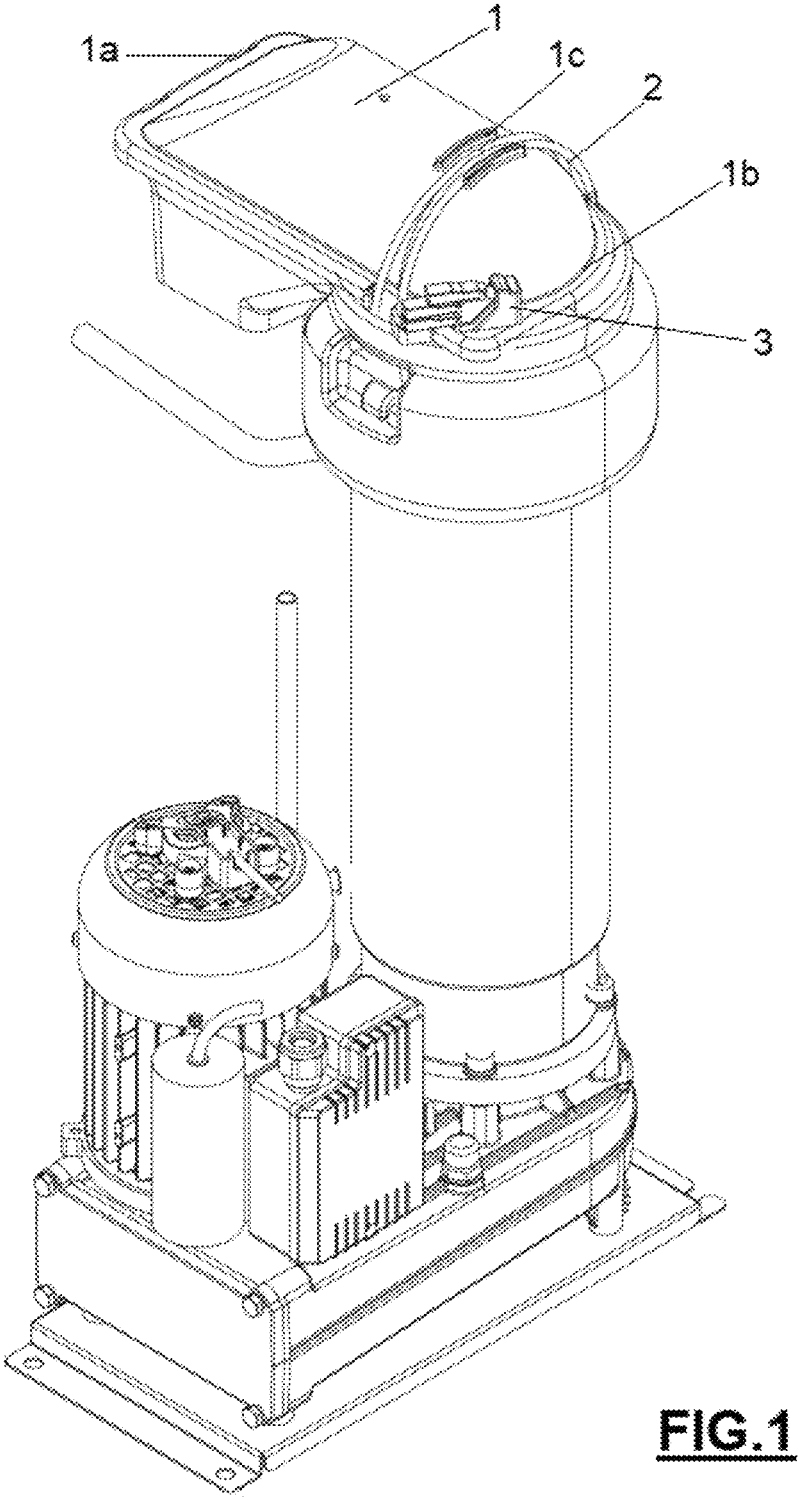
FIG. 1. Shows a view of the safety device for an ice machine, correctly mounted in an ice machine.
Figure 2:
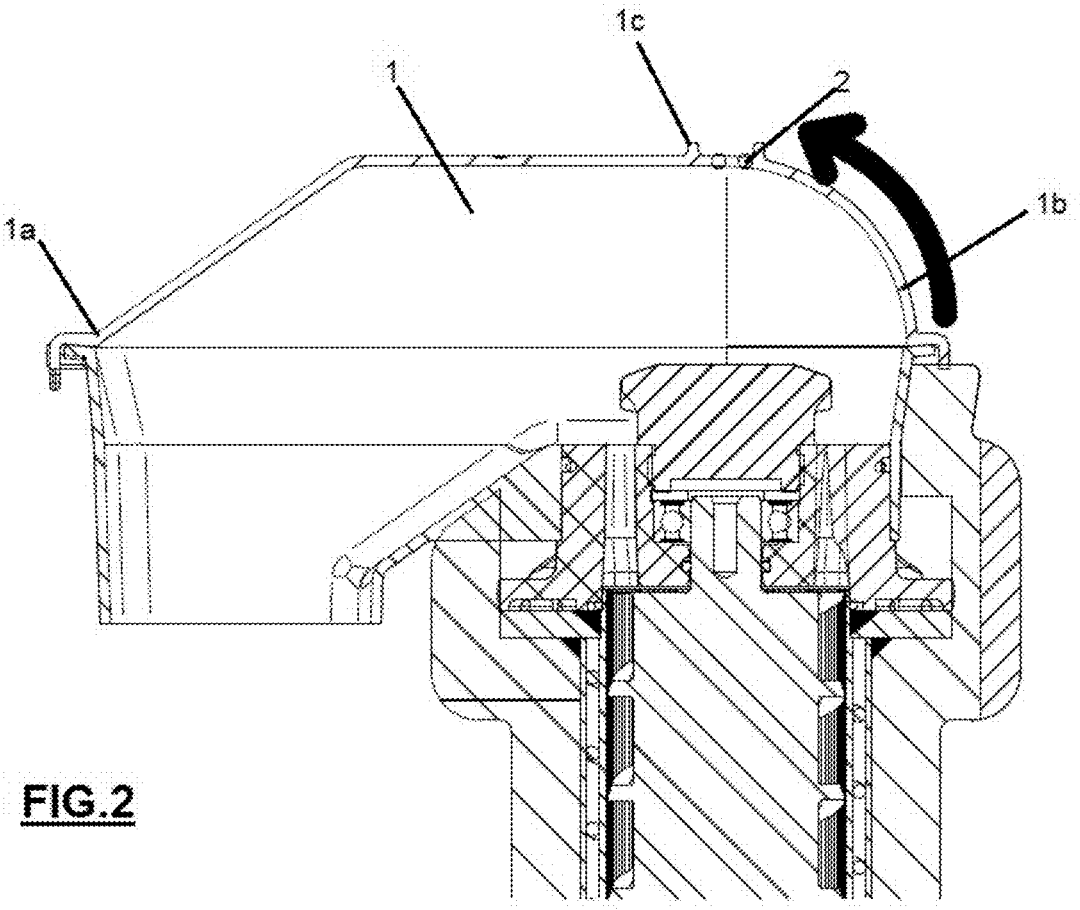
FIG. 2. Shows a cross-sectional view of the safety device for an ice machine, object of the present specification.
Figure 3:
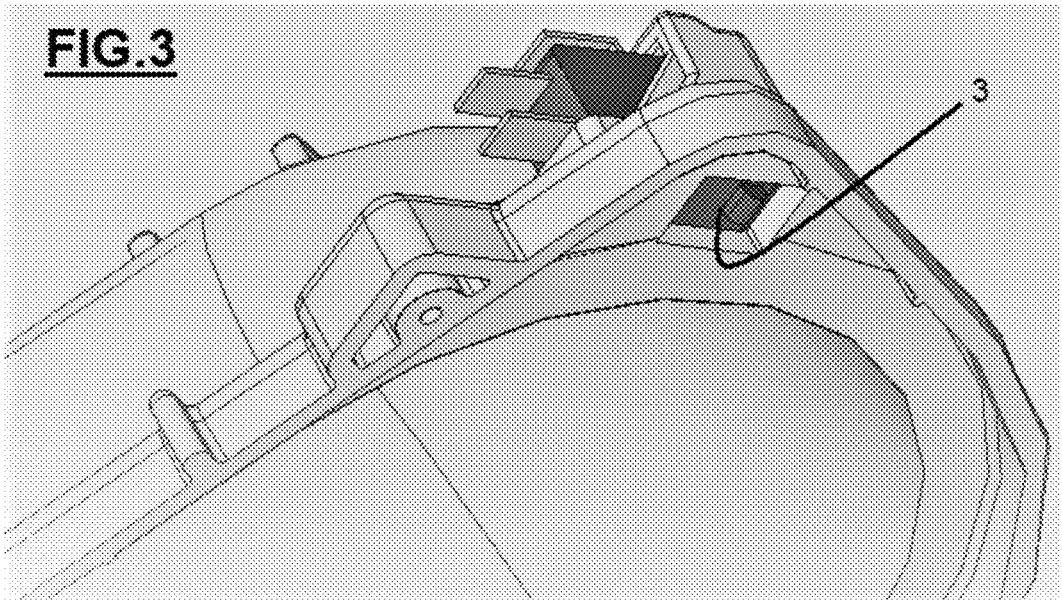
FIG. 3. Shows a detailed view of the electronic means (3) as part of the safety device for an ice machine, object of the present specification.

The body (1), on the end (1*b*) where the elastic closure (2) is located, houses electronic means (3), as shown in FIG. 3; responsible for detecting the change in position or opening of said body (1), sending a stop warning to the control means of the ice machine, and an external blockage or breakdown warning, so that an operator can access the cited area, for the repair thereof.

In a preferred embodiment, the electronic means (3) will be configured in a casing that houses a microchip, programmed to perform both the reading of the change in position in the body (1) and the sending of the stop signal and the breakdown warning.

In the case of the blockage disappearing, after a safety time has passed, the electronic means (3) will send a start-up signal to the control means of the machine, automatically resetting the machine, without the action of any operator.

The invention claimed is:

1. A safety device for an ice machine, the safety device comprising:

an elastic closure; and a cover-type body having a first end and a second end, the cover-type body having protuberances, wherein the protuberances are incorporated on said second end of said cover-type body and the protuberances make up an arrangement of the elastic closure responsible for fastening said cover-type body to the ice machine, and the second end acts as a housing area of electronic means responsible for at least one of reading or detecting a change in at least one of position or opening of said cover-type body and sending a machine stop signal and a breakdown warning.

2. The safety device for the ice machine according to claim 1, wherein the electronic means are configured to perform both the reading or the detecting of the change in position in the cover-type body and the sending of the machine stop signal and the breakdown warning.

3. The safety device for the ice machine according to claim 1, wherein the cover-type body having a spherical cap shape.

* * * * *